United States Patent [19]

Veselaski et al.

[11] Patent Number: 4,765,060

[45] Date of Patent: Aug. 23, 1988

[54] DISPOSABLE SHAVER HEAD

[75] Inventors: Stephen V. Veselaski, Bayshore; Curtis W. Delanoy, North Massapequa; Robert J. Nicola, West Sayville, all of N.Y.

[73] Assignee: Micro Contacts Inc., Hicksville, N.Y.

[21] Appl. No.: 15,689

[22] Filed: Feb. 17, 1987

[51] Int. Cl.[4] ..... B26B 11/02

[52] U.S. Cl. ..... 30/208; 30/223; 30/346.53

[58] Field of Search ..... 30/208, 223, 346.53

[56] References Cited

U.S. PATENT DOCUMENTS 2,542,378 2/1951 Armbruster et al. ..... 30/208

2,959,855 11/1960 Andis ..... 30/208

*Primary Examiner*—Frank T. Yost

*Assistant Examiner*—William Fridie

*Attorney, Agent, or Firm*—Lewis H. Eslinger

[57] ABSTRACT

A disposable head adapted for one-time use as an attachment to an electric shaver for cutting hair of a patient close to the skin in preparation for surgery has a lower portion comprising a lower plastic member adapted for engagement with a portion of the body of a patient to be shaved and a lower thin metal blade insert-molded integrally with the lower plastic member at an upper region thereof and an upper portion comprising an upper plastic member and an upper thin metal blade insert-molded integrally with the upper plastic member at a lower region thereof. The blades are opposed to and in contact with each other when the head is assembled, and each of the blades has an edge formed with a row of cutting teeth. The rows are substantially parallel to each other, and the teeth of each row are relatively reciprocable with respect to the teeth of the other row so as to cut hair drawn between a tooth of one row and an adjacent tooth of the other row.

20 Claims, 3 Drawing Sheets

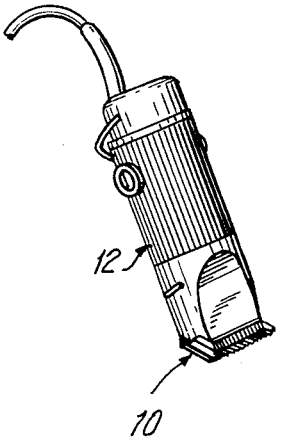
FIG. 1
FIG. 2
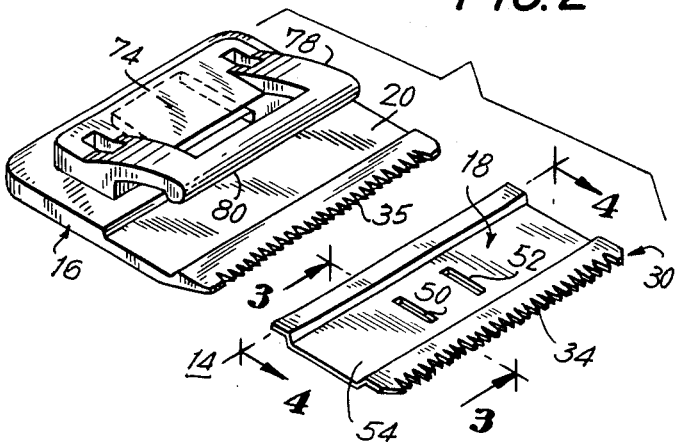
FIG. 3
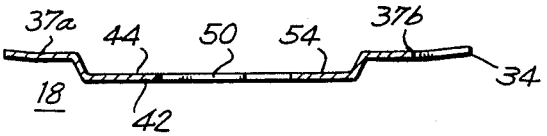
FIG. 4
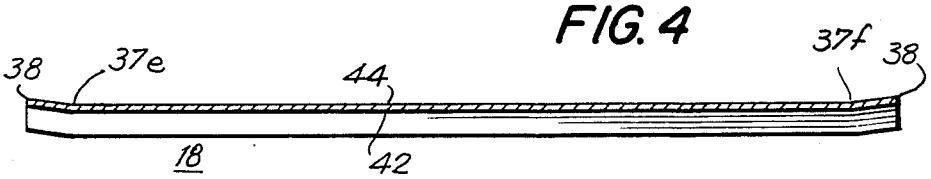

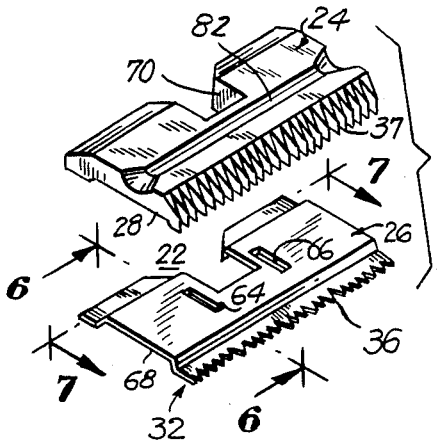
FIG. 5
FIG. 6
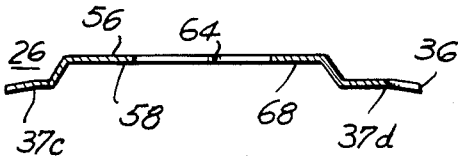
FIG. 7
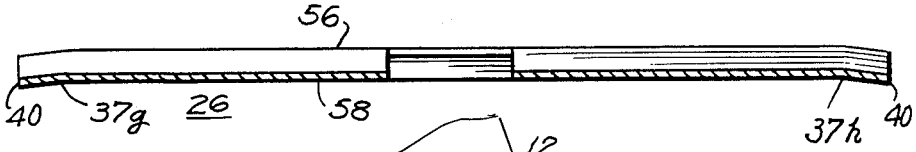
FIG. 8
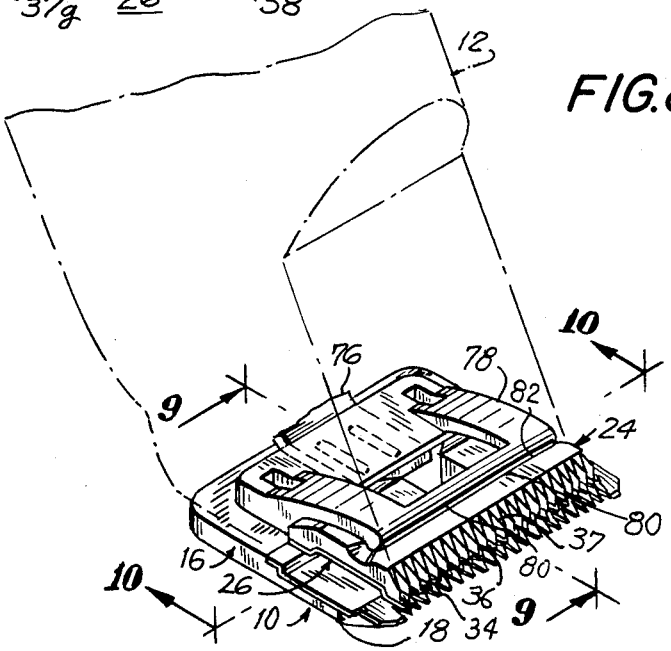

DISPOSABLE SHAVER HEAD

BACKGROUND OF THE INVENTION

1. Field of the Invention

This invention relates to shaving equipment and, more particularly, to a novel and highly-effective disposable head adapted for one-time use as an attachment to an electric shaver for cutting hair of a patient close to the skin in preparation for surgery.

2. Description of the Prior Art

In preparing a patient for surgery, it is standard practice to shave the skin of the patient in the vicinity of the region where the incision is to be made. This is usually done "wet", using a safety razor. Because of the need for shaving cream, hot water, a towel, etc., the shaving operation is inconvenient, messy, and time-consuming.

A "dry" shave in preparation for surgery is theoretically possible but as conventionally practiced suffers from even greater drawbacks and therefore is not normally attempted. An accepted principal drawback of a dry shave results from what has been considered to be an incompatibility between the need to hold costs to a minimum and the need to avoid transmitting contagious diseases, bacteria, etc., from one patient to another. The latter need dictates the use of disposable equipment or of sterilization procedures such as autoclaving. Sterilization procedures add to cost and are time-consuming and if not carefully practiced may fail to prevent the spread of contagious diseases, etc. Disposable equipment has heretofore been regarded as uneconomical in the case of heads for electric shavers, which are conventionally very expensive compared to disposable safety razors.

OBJECTS AND SUMMARY OF THE INVENTION

An object of the invention is to remedy the problems outlined above and, more particularly, to provide a disposable head adapted for one-time use as an attachment to an electric shaver for shaving a patient in preparation for surgery.

Another object of the invention is to provide an effective shaver head that is inexpensive enough to discard after a single use.

Another object of the invention is to facilitate dry shaving of a patient in preparation for surgery under conditions such that contagious diseases, bacteria, etc., are not spread from one patient to another.

Another object of the invention is to enable shaving of a patient in preparation for surgery more quickly and conveniently than is possible in conventional practice.

Another object of the invention is to facilitate shaving a patient for surgery without the use of shaving cream, towels or hot water.

These and other objects are attained in accordance with the invention by the provision of a disposable head adapted for one-time use as an attachment to an electric shaver for cutting hair of a patient close to the skin in preparation for surgery, the shaver head comprising: a lower portion comprising a lower plastic member adapted for engagement with a portion of the body of a patient to be shaved and a lower thin metal blade insert-molded integrally with the lower plastic member at an upper region thereof; and an upper portion comprising an upper plastic member and an upper thin metal blade insert-molded integrally with the upper plastic member at a lower region thereof; the blades being opposed to and in contact with each other when the head is assembled and each of the blades having an edge formed with a row of cutting teeth, the rows being substantially parallel to each other and the teeth of each of the rows being relatively reciprocable with respect to the teeth of the other of the rows so as to cut hair drawn between a tooth of one of the rows and an adjacent tooth of the other of the rows.

BRIEF DESCRIPTION OF THE DRAWING

A better understanding of the objects, features and advantages of the invention can be gained from the following detailed description of the preferred embodiment thereof, in conjunction with the appended figures of the drawing, wherein:

FIG. 1 is a perspective view of a disposable head in accordance with the invention mounted on an electric shaver drive assembly;

FIG. 2 is an exploded perspective view of a lower portion of the disposable shaver head of FIG. 1;

FIG. 3 is a sectional view taken substantially along the line 3—3 of FIG. 2 and looking in the direction of the arrows;

FIG. 4 is a sectional view taken substantially along the line 4—4 of FIG. 2 and looking in the direction of the arrows;

FIG. 5 is an exploded perspective view of an upper portion of the disposable shaver head;

FIG. 6 is a sectional view taken substantially along the line 6—6 of FIG. 5 and looking in the direction of the arrows;

FIG. 7 is a sectional view taken substantially along the lines 7—7 of FIG. 5 and looking in the direction of the arrows;

FIG. 8 is an assembled perspective view of the disposable head showing its attachment to the electric shaver drive assembly;

DESCRIPTION OF THE PREFERRED EMBODIMENTS

Figure 9:
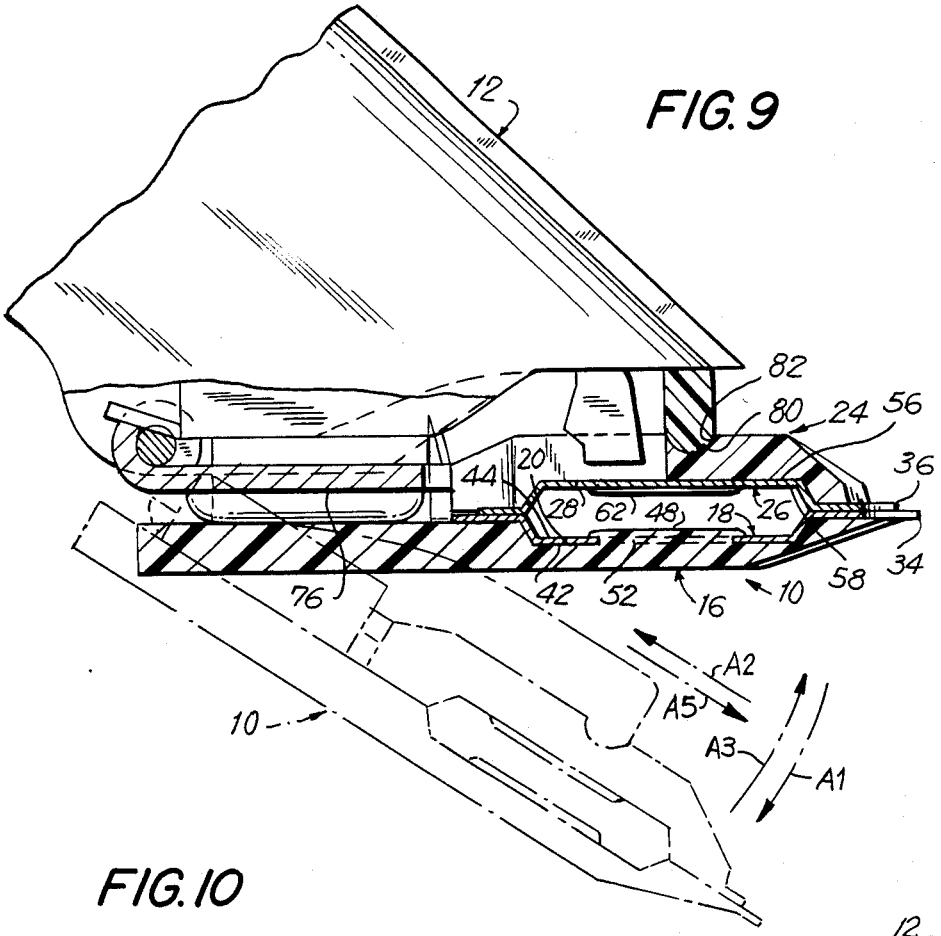
FIG. 9 is a sectional view taken substantially along the line 9—9 of FIG. 8 and looking in the direction of the arrows.
Figure 10:
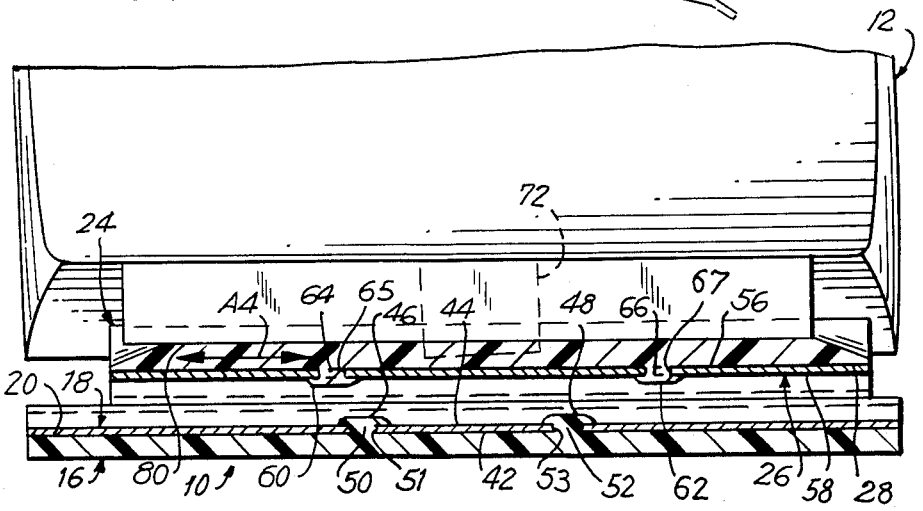
FIG. 10 is a sectional view taken substantially along the line 10—10 of FIG. 8 and looking in the direction of the arrows.

FIGS. 1 and 8–10 show a disposable head 10 adapted for one-time use as an attachment to an electric shaver 12 for cutting hair of a patient close to the skin in preparation for surgery. The head 10 comprises a lower portion 14 shown in isolation in FIG. 2. The lower portion 14 comprises a lower plastic member 16 adapted for engagement with a portion of the body of a patient to be shaved and a lower thin metal blade 18 insert-molded integrally with the lower plastic member 16 at an upper region 20 thereof. FIG. 2 is an exploded view; FIGS. 9 and 10 show the integral formation of the lower blade 18 with the upper region 20 of the lower plastic member 16.

The head further comprises an upper portion 22 (FIG. 5) comprising an upper plastic member 24 and an upper thin metal blade 26 insert-molded integrally with the upper plastic member 24 at a lower region 28 thereof. FIG. 5 is an exploded view, and FIGS. 9 and 10 show the integral formation of the upper blade 26 and the lower region 28 of the upper plastic member 24.

The blades 18 and 26 are opposed to and in contact with each other when the head 10 is assembled, and each of the blades 18 and 26 has an edge 30 or 32 formed with a row of cutting teeth 34 or 36. The rows of cutting teeth 34 and 36 are substantially parallel to each other and respectively backed up by serrated edges 35 and 37 of the lower plastic member 16 and upper plastic member 24, and the teeth 34 and 36 of each of the rows are relatively reciprocable with respect to the teeth of the other of the rows so as to cut hair drawn between a tooth of one of the rows and an adjacent tooth of the other of the rows.

At least one and preferably each of the blades 18, 26 is slightly concave towards the other in a plane normal to the rows of cutting teeth 34, 36 (see FIGS. 3 and 6). The concavity is formed at least in part by slightly bending the lower blade upwardly (FIG. 3) along bend lines *37a, 37b* and by slightly bending the upper blade downwardly (FIG. 6) along bend lines *37c, 37d*. This construction urges the rows of cutting teeth 34 and 36 firmly together.

Moreover, at least one and preferably each of the blades is slightly concave towards the other in a plane parallel to the rows of teeth 34, 36 (see FIGS. 4 and 7). Specifically, the lower blade is slightly bent upwardly (FIG. 4) along bend lines *37e, 37f*, and the upper blade is slightly bent downwardly (FIG. 7) along bend lines *37g, 37h*. This construction urges the ends 38 (FIG. 4) and 40 (FIG. 7) of the rows of teeth 34 and 36, respectively, firmly together.

The amount of bending along lines *37a–37h* is slight and displaces the extreme outer edges of the blades (when they are disassembled) in a direction normal to the large surfaces of the blades through a distance substantially equal to the thickness of the blades. In a practical embodiment, this may be about 0.0008 inch.

The lower blade 18 has two major sides 42, 44 (FIGS. 3 and 4), and the lower plastic member 16 engages primarily one of the sides 42, 44, namely the side 42, of the lower blade 18 and includes a flashing 46, 48 (FIGS. 9 and 10) that engages a small portion of the other side 44 of the lower blade 18.

The lower blade 18 is formed with at least one and preferably two apertures 50, 52 therein (FIGS. 2, 3, 9 and 10). Each aperture has a perimeter 51 or 53, and the flashing 46, 48 of the lower plastic member 16 engages the other side 44 of the lower blade 18 around the perimeters 51, 53 of the apertures 50, 52 in the lower blade 18.

The lower blade 18 is formed with a recessed portion 54, and the apertures 50, 52 in the lower blade 18 are formed in the recessed portion of the lower blade 18, whereby the flashing 46, 48 of the lower plastic member 16 is spaced apart from the upper blade 26 when the head 10 is assembled.

The upper blade 26 likewise has two major sides 56, 58 (FIGS. 6, 7, 9 and 10), and the upper plastic member 24 engages primarily one of the sides 56 of the upper blade 26 and includes a flashing 60, 62 that engages a small portion of the other side 58 of the upper blade 26.

The upper blade 26 is formed with at least one and preferably two apertures 64, 66 therein (FIGS. 5, 6 and 10). Each aperture has a perimeter 65 or 67, and the flashing 60, 62 of the upper plastic member 24 engages the other side 58 of the upper blade 26 around the perimeters 65, 67 of the apertures 64, 66 in the upper blade 26.

The upper blade 26 is formed with a recessed portion 68, and the apertures 64, 66 in the upper blade 26 are formed in the recessed portion 68 of the upper blade 26, whereby the flashing 60, 62 of the upper plastic member 24 is spaced apart from the lower blade 18 when the head 10 is assembled.

The apertures 50, 52 in the lower blade 18 and the apertures 64, 66 in the upper blade 26 are horizontally offset with respect to each other so that the flashing 46, 48 of the lower plastic member 16 and the flashing 60, 62 of the upper plastic member 24 are spaced apart from each other.

Since the apertures 50, 52 in the lower blade 18 are formed in the recessed portion 54 of the lower blade 18, the flashing 46, 48 of the lower plastic member 16 is spaced apart from the upper blade 26 when the head 10 is assembled. Moreover, since the apertures 64, 66 in the upper blade 26 are formed in the recessed portion 68 of the upper blade 26, the flashing 60, 62 of the upper plastic member 24 is spaced apart from the lower blade 18 when the head 10 is assembled. The apertures 50, 52 in the lower blade 18 and the apertures 64, 66 in the upper blade 26 are horizontally offset with respect to each other so that the flashing 46, 48 of the lower plastic member 16 and the flashing 60, 62 of the upper plastic member 24 are spaced apart from each other.

The lower portion 14 is stationary and the upper portion 22 is movable and formed with contoured means 70 (FIG. 5) adapted to engage a driving member 72 (FIG. 10) of the electric shaver 12. The contoured means 70 is formed as a slot in the upper plastic member 24.

The lower portion 14 is formed with anchor means 74 formed as a slot (FIG. 2) for releasably coupling the disposable head 10 to a coupling member or arm 76 (FIGS. 8 and 9) of the electric shaver 12 and with a cantilever arm 78 (best shown in FIGS. 2 and 8) that extends over the upper portion 22 for releasably coupling the lower and upper portions 14, 22 together.

The lower blade 18 and the upper blade 26 are made of stainless steel in a stamping process, and the lower plastic member 16 and upper plastic member 24 are made of polyamide in an injection molding process wherein the blades are respectively integrated into the plastic members as permanent inserts.

The head 10 is assembled by placing the lower portion 14 (comprising the lower plastic member 16 and the blade 18 insert-molded integrally therewith) and the upper portion 22 (comprising the upper plastic member 24 and the blade 26 insert-molded integrally therewith) end to end and then relatively sliding the portions 14, 22 in a direction normal to the plane of FIGS. 3 or 9 (i.e., left-to-right or right-to-left in FIGS. 4, 7 or 10) so that a boss 80 (best shown in FIGS. 2 and 8–10) on the cantilever arm 78 of the lower portion 14 slides in a groove 82 (best shown in FIGS. 5 and 9) formed in the lower portion 14. When the lower portion 14 and upper portion 22 are approximately centered with respect to each other, the cantilever arm 78 holds them securely together.

The assembled head is then mounted on the electric shaver 12 by pivoting the arm 76 clockwise (arrow A1, FIG. 9) as shown in phantom outline, moving the head 10 (arrow A2) so that the arm 76 engages in the slot 74 and then pivoting the structure (arrow A3) to the position shown in solid outline in FIG. 9. When the driving member 72 oscillates in the plane of FIG. 10, it drives the upper row of cutting teeth 34 left-to-right and right-to-left (double-headed arrow A4, FIG. 10) in a conventional manner. Thus hair drawn between a tooth of one of the rows 34, 36 and an adjacent tooth of the other of the rows is cut. To remove the head 10 thereafter for disposal, it is pivoted clockwise (arrow A1) as shown in phantom outline in FIG. 9, and then moved in the direction of the arrow A5 so that the arm 76 is withdrawn from the slot 74.

The blades 18 and 26 can be very thin in accordance with the invention, for example only 0.0008 inch. Because the blades are insert-molded integrally with a backing plastic and are slightly concave as described above, the rows of cutting teeth do not splay apart but are held firmly together for an efficient cutting action.

A disposable head in accordance with the invention can be manufactured very inexpensively and is suitable for one-time use. It is particularly adapted as an attachment to an electric shaver for cutting hair of a patient close to the skin in preparation for surgery.

Thus there is provided in accordance with the invention a novel and highly-effective disposable head for an electric shaver. Many modifications of the preferred embodiment of the invention disclosed above will readily occur to those skilled in the art upon consideration of this disclosure. For example, the location and size of the apertures 50, 52, 64 and 66, the depth of the recessed portions 54 and 68, and the degree of concavity of the blades 18 and 26 towards each other may all be varied within wide limits. Accordingly, the invention is to be construed as including all structure that falls within the scope of the appended claims.

We claim:

1. A disposable head adapted for one-time use as an attachment to an electric shaver for cutting hair of a patient close to the skin in preparation for surgery, said head comprising:

a lower portion comprising a lower plastic member adapted for engagement with a portion of the body of a patient to be shaved and a lower thin metal blade insert-moded integrally with said lower plastic member at an upper region thereof; and an upper portion comprising an upper plastic member and an upper thin metal blade insert-molded integrally with said upper plastic member at a lower region thereof;

said blades being opposed to and in contact with each other when said head is assembled and each of said blades having an edge formed with a row of cutting teeth, said rows being substantially parallel to each other and the teeth of each of said rows being relatively reciprocable with respect to the teeth of the other of said rows so as to cut hair drawn between a tooth of one of said rows and an adjacent tooth of the other of said rows.

2. A disposable head according to claim 1 wherein at least one of said blades is slightly concave towards the other in a plane normal to said rows of teeth, thereby urging said rows of teeth firmly together.

3. A disposable head according to claim 1 wherein each of said blades is slightly concave towards the other in a plane normal to said rows of teeth, thereby urging said rows of teeth firmly together.

4. A disposable head according to claim 1 wherein at least one of said blades is slightly concave towards the other in a plane parallel to said rows of teeth, thereby urging the ends of said rows of teeth firmly together.

5. A disposable head according to claim 1 wherein each of said blades is slightly concave towards the other in a plane parallel to said rows of teeth, thereby urging the ends of said rows of teeth firmly together.

6. A disposable head according to claim 1 wherein said lower blade has two major sides and said lower plastic member engages primarily one of said sides of said lower blade and includes a flashing of plastic material that engages a small portion of the other of said sides of said lower blade to integrate the plastic member with the lower blade.

7. A disposable head according to claim 6 wherein said lower blade is formed with at least one aperture therein, said aperture in said lower blade has a perimeter, and said flashing of said lower plastic member engages said other of said sides of said lower blade around said perimeter of said aperture in said lower blade.

8. A disposable head according to claim 7 wherein said lower blade is formed with a recessed portion and said aperture in said lower blade is formed in said recessed portion of said lower blade, whereby said flashing of said lower plastic member is spaced apart from said upper blade when said head is assembled.

9. A disposable head according to claim 1 wherein said upper blade has two major sides and said upper plastic member engages primarily one of said sides of said upper blade and includes a flashing of plastic material that engages a small portion of the other of said sides of said upper blade to integrate the plastic material with the upper blade.

10. A disposable head according to claim 9 wherein said upper blade is formed with at least one aperture therein, said aperture in said upper blade has a perimeter, and said flashing of said upper plastic member engages said other of said sides of said upper blade around said perimeter of said aperture in said upper blade.

11. A disposable head according to claim 10 wherein said upper blade is formed with a recessed portion and said aperture in said upper blade is formed in said recessed portion of said upper blade, whereby said flashing of said upper plastic member is spaced apart from said lower blade when said head is assembled.

12. A disposable head according to claim 1 wherein said lower blade has two major sides and is formed with at least one aperture therein, said aperture in said lower blade extends from one of said sides of said lower blade to the other of said sides of said lower blade and has a perimeter, and said lower plastic member engages primarily said one of said sides of said lower blade and includes a flashing of plastic material that engages said other of said sides of said lower blade around said perimeter of said aperture in said lower blade to integrate the plastic member with the lower blade; and said upper blade has two major sides and is formed with at least one aperture therein, said aperture in said upper blade extends from one of said sides of said upper blade to the other of said slides of said upper blade and has a perimeter, and said upper plastic member engages primarily said one of said sides of said upper blade and includes a flashing of plastic material that engages said other of said sides of said upper blade around said perimeter of said aperture in said upper blade to integrate the plastic material with the upper blade.

13. A disposable head according to claim 12 wherein said aperture in said lower blade and said aperture in said upper blade are horizontally offset with respect to each other so that said flashing of said lower plastic member and said flashing of said upper plastic member are spaced apart from each other.

14. A disposable head according to claim 12 wherein said lower blade is formed with a recessed portion and said aperture in said lower blade is formed in said recessed portion of said lower blade, whereby said flashing of said lower plastic member is spaced apart from said upper blade when said head is assembled;

said upper blade is formed with a recessed portion and said aperture in said upper blade is formed in said recessed portion of said upper blade, whereby said flashing of said upper plastic member is spaced apart from said lower blade when said head is assembled; and said aperture in said lower blade and said aperture in said upper blade are horizontally offset with respect to each other so that said flashing of said lower plastic member and said flashing of said upper plastic member are spaced apart from each other.

15. A disposable head according to claim 1 wherein said lower portion is stationary and said upper portion is movable.

16. A disposable head according to claim 1 wherein said lower portion is stationary and said upper portion is movable and formed with contoured means adapted to engage a driving member of said electric shaver.

17. A disposable head according to claim 16 wherein said contoured means is formed as a slot in said upper plastic member.

18. A disposable head according to claim 1 wherein said lower portion is stationary and formed with anchor means for releasably coupling said disposable head to said electric shaver and with a cantilever arm that extends over said upper portion for releasably coupling said lower and upper portions together.

19. A disposable head according to claim 18 wherein said anchor means is formed as a slot in said lower plastic member.

20. A disposable head according to claim 1 wherein said lower blade and said upper blade are made of stamped stainless steel and said lower plastic member and said upper plastic member are made of polyamide.

* * * * *

UNITED STATES PATENT AND TRADEMARK OFFICE

CERTIFICATE OF CORRECTION

PATENT NO. : 4,765,060

DATED : August 23, 1988

INVENTOR(S) : Stephen V. Veselaski et al.

It is certified that error appears in the above-identified patent and that said Letters Patent is hereby corrected as shown below:

Column 4, line 52, change "FIGS." to --FIG.--;

line 53, change "FIGS." to --FIG.--.

IN THE CLAIMS

Column 6, line 55, change "slides" to --sides--.

Signed and Sealed this

Eleventh Day of April, 1989

*Attest:*

DONALD J. QUIGG

*Attesting Officer*

*Commissioner of Patents and Trademarks*